United States Patent [19]

Bass

[11] 4,320,883

[45] Mar. 23, 1982

[54] POSITIONABLE TOY/BOTTLE HOLDER

[76] Inventor: Wayne E. Bass, 8839 Keremeos Way, San Diego, Calif. 92126

[21] Appl. No.: 162,004

[22] Filed: Jun. 23, 1980

[51] Int. Cl.[3] ..... A47D 15/00

[52] U.S. Cl. ..... 248/104

[58] Field of Search ..... 248/102, 104, 228

[56] References Cited

U.S. PATENT DOCUMENTS 3,161,392 12/1964 Kopec et al. ..... 248/104

3,180,600 4/1965 Kopec ..... 248/104

*Primary Examiner*—George T. Hall

*Attorney, Agent, or Firm*—Frank D. Gilliam

[57] ABSTRACT

A positionable support for a baby bottle comprising interchangeable head members with openings representing the mouth of the characterization which the head represents, the opening contains a groove or channel for receiving and holding a resilient ring member which grasps and firmly holds a baby bottle, an extension arm supports the head member at a distance spaced from a base member. The extension arm, head and base member attachments are pivotable. The head member is removable from the extension arm pivot connection. A novel valve is included to prevent liquid from flowing from the nipple attached end of the baby bottle from the effect of gravity on the liquid therein.

16 Claims, 11 Drawing Figures

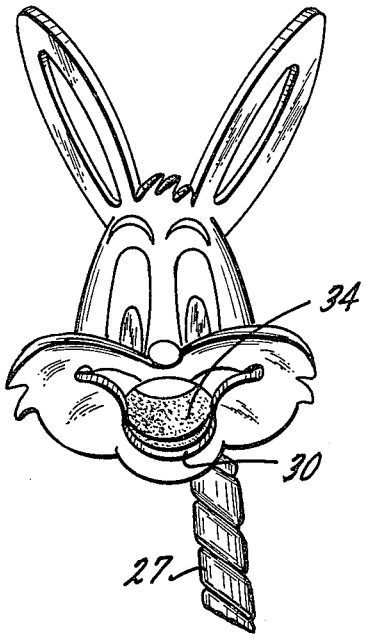
FIG. 4
FIG. 7
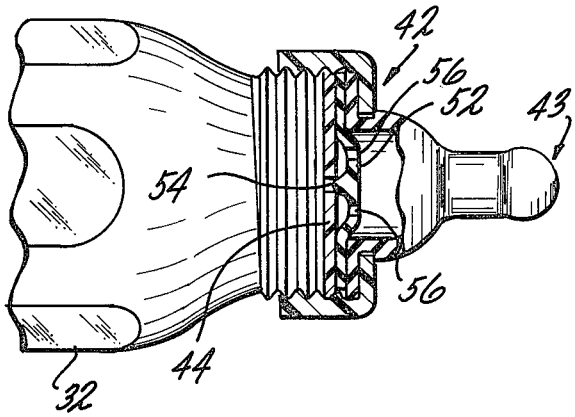
FIG. 8a
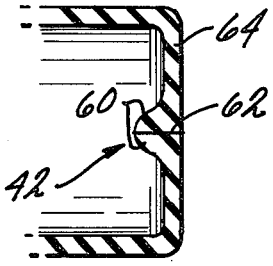
FIG. 8b
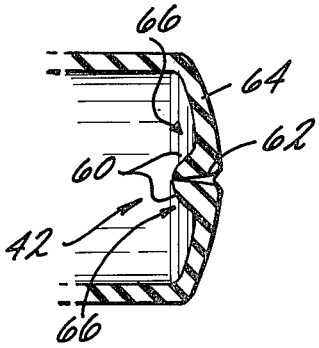
FIG. 8c
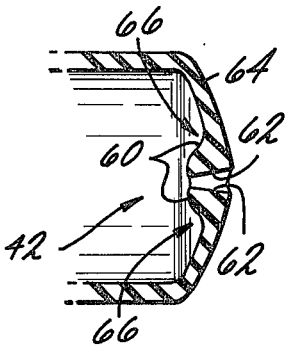
FIG. 9
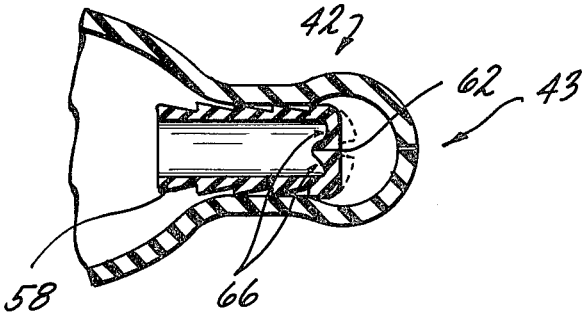

POSITIONABLE TOY/BOTTLE HOLDER

BACKGROUND OF THE INVENTION

The invention is directed to baby bottle holders and more specifically to baby bottle holders which are capable of freely positioning while firmly holding the baby bottle.

The existing art contains a plurality of different type baby bottle holders, all of which have various inadequacies that prevent their wide market acceptance. These existing devices include those taught by the following U.S. Pat. Nos.: 892,800; 1,077,190; 2,110,037; 1,368,544; 1,671,085; 2,446,478; 2,530,478; 2,605,069; and 3,251,626. These known devices generally all teach an adjustable clamping means or open spring means for grasping around a portion of the bottle for securing the bottle to the holding device. U.S. Pat. No. 2,530,478, in particular, teaches an open spring means lined with rubberized material. This device, like several of the above mentioned patented devices includes a non-continuous spring grasping means for securing the baby bottle to the holding device. It would be quite easy for babies to disengage bottles from these devices.

There has not been a completely satisfactory baby bottle holding means until the emergence of this invention.

SUMMARY OF THE INVENTION

This invention pertains to an improved baby bottle holding means which has interchangeable bottle securing heads each of which represents a different characterization of a person, animal, etc. which both securely holds the bottle for the baby during feeding and amuse the baby. The bottle holder is freely positionable by the grasping and pulling on the bottle without fear of the bottle becoming disattached from the head. A novel valve is provided for insertion between the open end of the bottle and the outer tip of the nipple to prevent liquid flow through the nipple by the effect of gravity on the liquid contained in the bottle.

The holding means includes an opening through the head that is representative of the mouth of the characterization which the head represents. The mouth is lined with resilient material with sufficient resiliency to firmly grasp and hold bottles having different diameters within a given range of diameters, thus allowing the head of the device to be repositioned even by grasping and pulling on the bottle.

The head portion of the bottle holder takes the shape of a recognizable natural or frictional character which provides amusement to the baby during feeding or on other occasions between feedings when the baby is temporarily unattended.

A plurality of different heads representing a plurality of different characterizations, are freely interchangeable on the extension arm of the holding device.

The pivots between the extension arm and the head portion and clamp or base are tension adjustable so as to provide a selected pivot tension at the pivots to insure ease in the pivoting of the device when the head portion is repositioned by grasping and pulling upon the bottle so that the bottle does not become disengaged from the mouth of the head portion. The pivot tension may, of course be adjusted to prevent either or both pivots from movement.

A plurality of different embodiments of valve means, those which are used with a conventional nipple or integral with the nipple, are provided for placement across the open end of the baby bottle between the bottle and the mouth of the baby to prevent the flow of the fluid from the bottle through the nipple due to the effect of gravity.

Further, improvements and advantages of this invention will readily appear to those skilled in the art when the following description is read in view of the accompanying drawings in which:

BRIEF DESCRIPTION OF THE DRAWINGS

FIG. 4 is a showing of a second embodiment of the head portion interchangeable with the head portion of FIGS. 1 and 3.

FIG. 7 is a cutaway showing of a second embodiment of the flow control valve.

FIGS. 8*a*, 8*b* and 8*c* are enlarged cutaway showings of a third embodiment of the flow central valve shown with the valve in a closed position, an intermediate position and an open position respectively.

FIG. 9 is a cutaway showing of a slight variation of the third embodiment of the flow control valve.

DETAILED DESCRIPTION OF THE INVENTION

Figure 1:
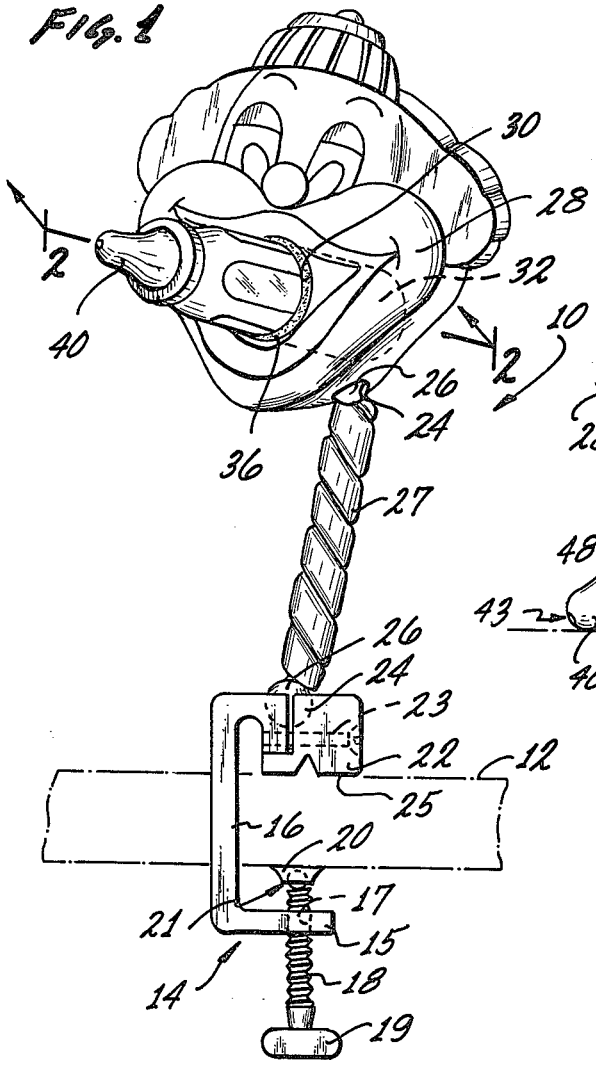
FIG. 1 is a perspective elevation view of the positionable baby bottle holder of the invention.
Figure 2:
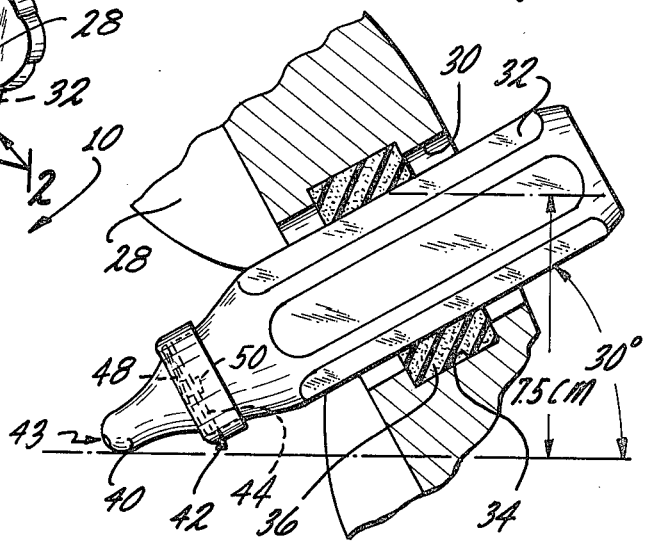
FIG. 2 is a partial cutaway portion taken along line 2—2 of FIG. 1.

Referring now to the various figures of the drawings for a more detailed description thereof, in which similar characters of reference denote the same part or element, and in which:

Referring now to FIGS. 1, 2 and 4, there is shown a baby bottle positioning and holding device 10. The device is shown clamped to a fixed object 12, such as, but not limited to, a table, high chair, baby carriage, stroller, buggy, crib or the like so that the baby bottle can be held unattended in a baby feeding position.

The clamp 14 may take many specific forms generally resembling an open "C". The distal end 15 of a rigid clamp body 16 has threaded opening 17 therethrough. A threaded screw 18 mates with the threads of opening 17. The length of screw 18 is adjustable with respect to clamp body 16 by the turning of the inverted "T" shaped handle 19. The end of the screw 18 remote from handle 19 includes a base member 20. The base member 20 may be pivotly attached to the screw 18 through a ball and socket 21 as shown or rigidly attached as is handle 19. The clamp surface opposing base member 20 is formed by a section 22. Section 22 is adjustably attached to rigid clamp body 16 by a screw 23 which passes through section 22 and threadly engages threads in the clamp body. The section 22 is positionably adjustable relative to clamp body 16, the purpose of which is hereinafter discussed in more detail. A spherical opening or ball socket 24 is formed by the clamp body 16 and the section 22. Each portion of the ball socket 24 is more than a quarter sphere and less than a semi-phere so as to capture a ball end 26 (see FIG. 3) of extension member 27 and yet allow freedom of movement of the ball within its socket.

Figure 3:
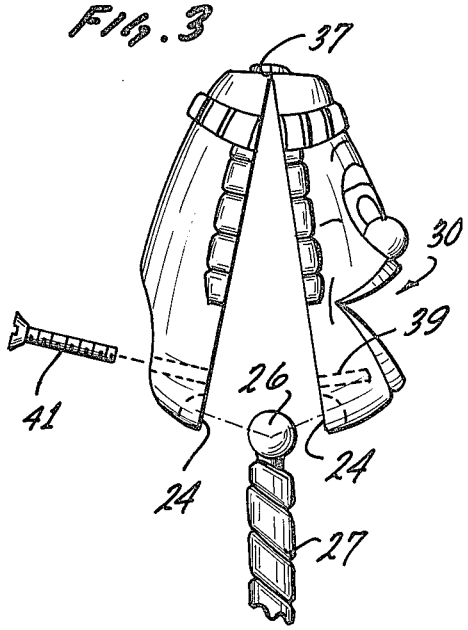
FIG. 3 is a showing of the head portion of FIG. 1 removed from the extension member.

Referring now to FIGS. 1 and 3, the bottle holding or head portion 28 includes an opening 30 which passes through the head portion 28 from front to back. The head portion generally takes the form of a characterization easily recognizable by an infant, such as, but not limited to, clowns, cartoon characters, animals or the like. The opening 30 is positioned at the location of the mouth of the characterization. The opening 30 is of a larger diameter than the largest diameter baby bottle 32 for which is to be inserted therethrough for support. The opening 30 could be of any convenient diameter but would generally the diameter would be in the range of 2.00 to 2.50 inches. The opening 30 is recessed within the head to form a groove 34.

A resilient ring member 36 is positioned within the groove 34. The inner diameter of the ring member 36 is smaller than the outer diameter of the opening 30 and therefore extends into the opening 30. The amount of extension of the ring member 36 into the opening 30 is generally in the range of from 0.1875 to 0.375 inches. The outer diameter of the ring member 36 is from 0.1875 to 0.375 inches larger than the opening 30 and corresponds to the diameter of the groove 34. The smaller inner diameter of the resilient ring member 36 allows for distortion of the ring member by way of expansion of the inner diameter when accommodating baby bottles 32 of various different diameters, within a selected range of diameters, and yet provide sufficient friction or grasping force between the inner surface of the resilient ring member 36 and the baby bottle 32 to prevent resistance to unwanted bottle movement with respect to the head portion. The ring member 36 is easily removable from the groove 34 for the purpose of cleaning, wear replacement and opening size selection to accommodate various bottle sizes. The ring member 36 may be constructed of any type of suitable material having the aforementioned resilient characteristics, typically, but only by the way of example and not by way of limitation, rubber, soft plastic or the like. The principle characteristics of the resilient member are ease of deformation of the inner opening when a baby bottle is inserted and yet provides sufficient friction or grasping force to prevent any undesired bottle movement within the ring member if the bottle is pulled on.

To further insure that the bottle will not be pulled from the ring member by the baby, the size of the ball sockets 24 are adjustable with respect to ball ends 26 by screws 23, 41 so that the combined resistance against the rotation of ball ends 26 is less than the resistance of the grasping force of the resilient ring member 36 with respect to baby bottle 32. This adjustment further aids in the retention of the bottle in the holding means when the baby, for example, grabs and pulls on the bottle. This action by the baby ideally will merely reposition the head portion. It should be understood that if the head portion is desired to be held in a fixed position with respect to the fixed object 12, this also can be accomplished by the adjustment of screws 23, 41.

The head extension member 27 and clamp 14 may be constructed of any suitable material such as, by way of example and not by way of limitation, plastic, wood, metal, ceramic, etc. or any combination thereof.

Referring now to FIG. 3, the head portion 28, like the clamp 14, is attached to a ball 26 of extension member 27 by means of a like ball socket 24 that is less than a complete sphere and more than a semi-sphere in diameter. The head portion is formed by two sections (front and rear). The two sections are pivotly connected together at their upper surfaces 37 by suitable means. Each section, like 16, 23 of the clamp 14, has a partial ball socket 24. The screw 41 passes through one-half of the head and threadly engages the other half at 39. By the adjustment of screw 41, not only are the havles held together but the diameter adjustment of ball socket 24 is accomplished, the purpose of which is hereinbefore discussed. It should be obvious that the head portion 28 is easily removable from ball end 26 by the loosening or removing the screw 41 and spreading the two halves apart about pivotal connection 37. Installation of the head member is accomplished in a reverse manner.

It has been found that common conventional nipples 40 used in the bottle feeding of babies, even when new, allow fluid contained therein to drip from the nipple orfice when the bottle is tipped toward the nipple end. It has been established that eight ounces of water in a bottle which is tipped toward the nipple end at an angle of 30° with the horizontal has approximately 7.5 cm $H_2O$ head pressure. To prevent the nipple from dripping while held by the positionable bottle holder of the invention when not positioned in a baby's mouth a valve member 42 is utilized. The valve member 42 may be inserted between the open end of the bottle 32 and the nipple 40 or formed within the nipple outer end or tip 43. The valve member is required to be closed (see FIG. 8*a*) to prevent liquid flow from the nipple 40 at 7.5 cm $H_2O$ head pressure, but must be easily operable to an open position (see FIG. 8*c*) by the sucking produced by the infant on the nipple during feeding. The range of infant sucking pressure has been determined to be from 10 to 30 cm $H_2O$ (*Physiology and Pathology of Infant Nutrition*—2nd Edition, L. F. Meyer and Erich Nassau—Charlies C. Thomas, Springfield, Illinois). Accordingly, the valve member 42 is designed to be drip tight at 7.5 cm $H_2O$ and to fully open with a minimum of sucking pressure at all inclinations up to an angle of approximately 30° from the horizontal but never require a sucking pressure greater than 10 cm $H_2O$. Obviously, only a minimum amount of sucking pressure is required to open the valve of a full bottle positioned at approximately 30° from the horizontal while at the worst extreme, a nearly empty bottle or a bottle tipped near 0° horizontal where 1 cm $H_2O$ of head pressure is present, 6.5 cm $H_2O$ of sucking pressure will be required to begin fluid flow.

Figure 5:
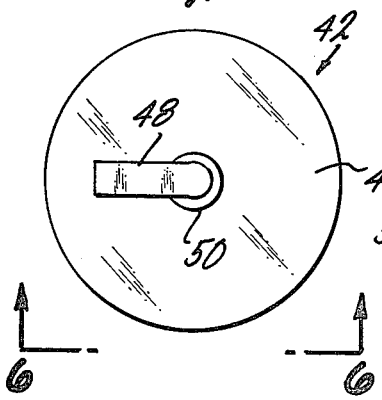
FIG. 5 is an end view of one embodiment of the flow control valve.
Figure 6:
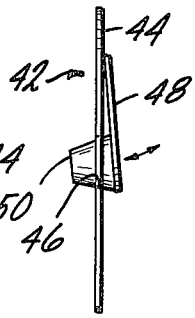
FIG. 6 is a showing taken along line 6—6 of FIG. 5.

In a first embodiment, (FIG. 5), the valve member 42 comprises a body or disk 44 constructed of substantially rigid material or a material that can be held rigid when positioned across the open mouth of a baby bottle. The disk 44 contains a centrally located aperature 46. A tab or arm 48 is attached to the disk at one end. The now distal end of the tab or arm 48 has a frustro conic plug 50 attached thereto. The plug 50 is postioned to be received, at least partially, within the aperature 46. The tab or arm 48 is constructed of a material of selected resiliency for holding the plug into the aperture in a sealing relationship and releasing it therefrom within the range of pressures above mentioned. A modified version of the valve member 42 (see FIG. 7) utilizes an inner diaphram 52 with a protrusion 54 of a conic shape in lieu of the plug 50 and orifices 56 through the diaphram 52 for liquid flow when the valve is open. Another embodiment of valve member 42 located in nipple tip 43 (see FIGS. 8*a*, 8*b*, and 8*c*). This embodiment may additionally take the form of a nipple insert 58 (see FIG. 9). The valve member 42 of FIGS. 8*a–c* or 9 has a central end of controlled material thickness 60 with a slit 62 centrally located. The sequence of valve action is shown in FIGS. 8*a*, 8*b* and 8*c*. FIG. 8*a* shows slit 62 in its normally closed to fluid flow condition as a result of equal pressure on both sides of the end wall 64; FIG. 8*b* shows the effect of a moderate sucking pressure along the arrows 66 on one side of wall 64 caused by infant sucking pressure; and FIG. 8*c* shows the effect of sufficient infant sucking pressure to bow end walls 64 opening slit 62 allowing liquid to flow through the parted slit.

The flexible parts used in the construction of the valve member 42 need elastomeric properties and must be easily formed into the constituent valve parts, by way of example and not by way of limitation, the parts may be formed of molded natural rubber, a synthetic elastomer, such as, molded flexible urethane or the like. The rigid disk portion can be molded from any rigid plastic that can withstand boiling water temperature and detergents, such as, for example, polycarbonate.

Many changes may be made in the details of the instant invention, in the method and materials of fabrication, in the configuration and assemblage of the constituent elements, without departing from the spirit and scope of the appended claims, which changes are intended to be embraced therein.

Having thus described the invention, what is claimed as new and useful and desired to be secured by United States Letters Patent is:

1. A positionable support for a baby bottle, selected from a plurality of baby bottles having a range of different diameters comprising:

a bottle holding member with a bottle insertable opening therethrough, a groove formed within said opening, a removable resilient ring member inserted into and held by said groove, said resilient ring member extending into said opening whereby a baby bottle inserted through said ring member is held thereby;

an extension member pivotly attached at one end to said bottle holding member; and a base member pivotly attached to the other end of said extension member, said base member includes clamp means for clamping said base member to a support surface;

the resiliency of said resilient ring member provides substantial resistance to any movement of said baby bottle inserted therein.

2. The invention as defined in claim 1 wherein the resistance of movement to said baby bottle provided by said resilient ring member is greater than the combined resistance of movement of the pivot attachments between said bottle holding member and said base member with said extension member.

3. The invention as defined in claim 1 wherein said bottle holding member is in the form of a head with said opening representing the mouth.

4. The invention as defined in claim 1 wherein said pivot means includes adjustment means for adjusting their resistance to movement.

5. The invention as defined in claim 1 wherein said resilient ring member is constructed of rubber.

6. The invention as defined in claim 1 wherein said resilient ring member is constructed of plastic.

7. The invention as defined in claim 1 wherein a plurality of baby bottle holding members each having different surface features each representing different characterizations may be interchangeably attached to said extension member.

8. A positionable support for baby bottles containing a liquid having an open end enclosed by a nipple, said baby bottles having a range of different diameters comprising:

a bottle holding member held by said channel and with a bottle insertable opening therethrough, a channel formed around said opening, a resilient ring member extending into said opening whereby a baby bottle having a selected diameter within a range of different diameters inserted through said resilient ring is held in position by the grasping force of said resilient ring member;

an extension arm pivotly attached at one end through pivot means to said bottle holding member;

a base member pivotly attached to the other end of said extension arm through pivot means, said base member includes clamp means for clamping said base member to a support surface; and valve means for preventing the flow of said liquid from said nipple due to gravitational forces acting thereon when said baby bottle is held by said positionable support in a position wherein the nipple enclosed open end is less than approximately a 30° angle below the horizontal.

9. The invention as defined in claim 8 wherein said grasping force is greater than the combined frictional force of the pivotal attachments at each end of said extension arm.

10. The invention as defined in claim 8 wherein said baby bottle holding member is in the form of a characterization of a head and said opening represents the mouth therein.

11. The invention as defined in claim 8 wherein said pivot means includes adjustment means for adjusting their resistance to movement.

12. The invention as defined in claim 8 wherein said valve means comprises a substantially rigid disk member positioned across the open end of said bottle with an aperture therethrough and a flapper valve member comprising a resilient arm attached to said disk at one end with its distal end, said flapper valve comprising a frustro conic plug for insertion into said aperature and normally sealing said opening thereby.

13. The invention as defined in claim 12 wherein said disk and said arm are constructed of plastic, the resilience of said arm being greater than that of said disk.

14. The invention as defined in claim 8 wherein said valve means comprises a disk member positioned across the open end of said bottle between said bottle and said nipple, said disk member having an aperture therethrough and a flexible diaphram positioned between said disk member and the outer end of said nipple, said diaphram includes orifices therethrough and a valve member for closing said aperture to prevent liquid flow through said aperture and said orifices to said nipple and for allowing liquid flow through said aperture and said orifices to said nipple when said valve member is open.

15. The invention as defined in claim 8 wherein said valve means comprises a sealing member with a centrally located slit therethrough, the lips on each side of said slit have a greater thickness than the walls adjacent thereto.

16. The invention as defined in claim 15 wherein said sealing member forms an intrical part of said nipple.

* * * * *